United States Patent [19]

Sawada et al.

[11] 4,426,432

[45] Jan. 17, 1984

[54] ELECTROPHOTOSENSITIVE RECEPTOR WITH TRISAZO COMPOUND

[75] Inventors: Kiyoshi Sawada; Satoshi Goto; Osamu Sasaki; Jiro Takahashi; Tawara Komamura, all of Hino, Japan

[73] Assignee: Konishiroku Photo Industry Co., Ltd., Tokyo, Japan

[21] Appl. No.: 372,228

[22] Filed: Apr. 26, 1982

[30] Foreign Application Priority Data

May 7, 1981 [JP] Japan ..... 56-69176

[51] Int. Cl.[3] ..... G03G 5/06

[52] U.S. Cl. ..... 430/58; 430/70; 430/72; 430/73; 430/74; 430/76; 430/78; 430/79; 260/157; 260/164; 260/169

[58] Field of Search ..... 430/58, 59, 70, 72, 430/73, 74, 76, 78, 79; 260/169

[56] References Cited

U.S. PATENT DOCUMENTS

| | | | |
|---|---|---|---|
| 2,286,714 | 6/1942 | Chechak | 260/169 X |
| 3,804,630 | 4/1974 | Loefeel et al. | 260/169 X |
| 3,877,949 | 4/1975 | Frohlich et al. | 260/169 X |
| 4,279,981 | 7/1981 | Ohta et al. | 430/58 X |
| 4,348,470 | 9/1982 | Kotima et al. | 430/58 X |

FOREIGN PATENT DOCUMENTS

| | | | |
|---|---|---|---|
| 34497 | 8/1981 | European Pat. Off. | 430/70 |
| 2360708 | 12/1975 | Fed. Rep. of Germany | 260/169 |
| 55-117151 | 9/1980 | Japan | 430/78 |

*Primary Examiner*—Roland E. Martin, Jr.

*Attorney, Agent, or Firm*—Frishauf, Holtz, Goodman & Woodward

[57] ABSTRACT

There is disclosed an electrophotosensitive receptor which comprises a conductive support and an electrophotosensitive layer which comprises a carrier transporting material and a specified trisazo compound wherein the azo compound is applied as a coating solution containing a solvent or as a liquid dispersion mixture containing a dispersion medium. Alternatively, the electrophotosensitive receptor comprises a conductive support and an electrophotosensitive layer which comprises said azo compound wherein the azo compound is applied as a coating solution containing a solvent and a binder or as a liquid dispersion medium containing a dispersion medium and a binder.

15 Claims, 6 Drawing Figures

ELECTROPHOTOSENSITIVE RECEPTOR WITH TRISAZO COMPOUND

BACKGROUND OF THE INVENTION

Figure 1:
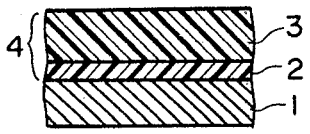

The present invention relates to an electrophotosensitive receptor, and more particularly to a novel electrophotosensitive receptor having an electrophotosensitive layer containing an azo compound, and further particularly it relates to a highspeed and highly durable electrophotosensitive receptor suitable for repetitive use.

As an electrophotosensitive receptor those having an electrophotosensitive layer consisting principally of such inorganic photoconductors as selenium, zinc oxide, cadmium sulfide or the like have been widely known. However, these are not necessarily satisfactory in respect of the sensitivity, thermal stability, moisture resistance and durability, and particularly, the use of selenium and cadmium sulfide has been restricted due to their toxicity.

On the other hand, an electrophotosensitive receptor having an electrophotosensitive layer consisting principally of an organic photoconductive compound have many such advantages that they can be readily manufactured, are inexpensive, can be easily handled and are generally excellent in the thermal stability as compared to selenium electrophotosensitive receptors, so that they have attracted attention recently.

As such an organic photosensitive compound, poly-N-vinyl carbazole is well known, and an electrophotosensitive receptor having an electrophotosensitive layer consisting principally of a charge-transfer complex formed from the above compound and such Lewis acids as 2,4,7-trinitro-9-fluorenone or the like has already been made practical reality. However, the electrophotosensitive receptor is not necessarily satisfactory in the speed and the durability.

On the other hand, a multilayered type electrophotosensitive receptor wherein the carrier-generating function and the carrier transport function are shared by different materials respectively or of the function separative type of the dispersion type have been known. Such function separative type photoreceptor has the advantages that they allow material for the functions to be selected in a wide range and that they permit to relatively readily prepare an electrophotosensitive receptor having such arbitrary properties as the charging property, speed, durability and the like. Various carrier generation materials or carrier transport materials using the above electrophotosensitive receptor have heretofore been proposed. For example, there have been made practical reality such an electrophotosensitive receptor as having an electrophotosensitive layer composed in combination of a carrier generation layer consisting of an amorphous selenium and a carrier transport layer consisting principally of poly-N-vinyl carbazole. However, the carrier generation layer consisting of amorphous selenium has the disadvantage that it has inferior thermal resistance.

And, the use of organic dye or pigment as the carrier generation material has been variously proposed, for example, electrophotosensitive layers containing a monoazo compound or bisazo compound is already in the prior art as described in Japanese Patent Examined Publication No. 30513/1973, Japanese Patent Publication Laid-open to Public Inspection (hereinafter referred to as Japanese Patent O.P.I. Publication) No. 4241/1977 and No. 46558/1979, Japanese Patent Examined Publication No. 11945/1981, and the like. However, these azo compounds are not necessarily satisfactory in the speed, residual potential or stability when repeatedly used, and in addition, the carrier transport material selectable range may be restricted, so that it is the actual situation that there have not been obtained any materials that can meet sufficiently the extensive needs of the electrophotographic process.

SUMMARY OF THE INVENTION

It is an object of the present invention to provide an electrophotosensitive receptor having an azo compound that is stable against heat and light, and excellent in the carrier generation capability.

It is another object of the present invention to provide an electrophotosensitive receptor having a high sensitivity, small residual potential and excellent durability that these properties may not be changed even when repeatedly used.

It is a further object of the present invention to provide an electrophotosensitive receptor containing an azo compound that is capable of acting effectively as a carrier generation material even in combination in a wide range with carrier transport material.

We, as a result of having devoted ourselves to studies to accomplish the above objects, have found that an azo compound represented by the following formula is capable of acting as an effective component of an electrophotosensitive receptor, and thus we have completed the present invention, said compound represented by the formula [I]:

$$A—N{=}N—Ar_1—N{=}N—Ar_2—N{=}N—A \qquad [I]$$

wherein $Ar_1$ and $Ar_2$ individually represent a divalent aromatic ring (preferably the aromatic ring is of the carbocyclic aromatic ring or a heterocyclic aromatic ring.);

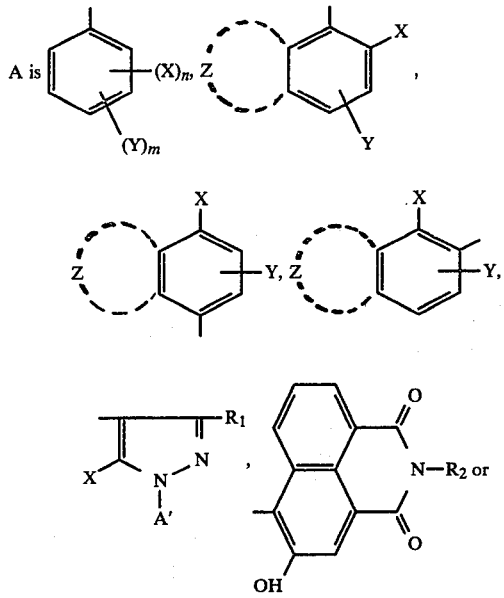

-continued

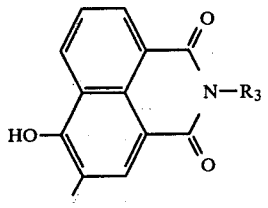

wherein X is a hydroxy,

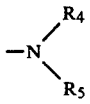

or —$NHSO_2$—$R_6$ wherein $R_4$ and $R_5$ individually represent a hydrogen or an alkyl group, $R_6$ represents an alkyl group or an aryl group; Y represents a hydrogen, a halogen, an alkyl group, an alkoxy group, a carboxy group, a sulfo group, a carbamoyl group or a sulfamoyl group; Z represents an atomic group or groups necessary for forming an aromatic ring (preferably the aromatic ring is a carbocyclic aromatic ring or a heterocyclic aromatic ring); A' represents an aryl group; $R_1$ represents a hydrogen, an amino group, an alkyl group, a carbamoyl group or a carboxy group or ester group thereof; $R_2$ and $R_3$ individually represent an alkyl group, an aralkyl group or an aryl group; n represents 1 or 2; and m represents 0, 1 or 2.

In this invention, preferably the carbocyclic aromatic ring in general formula [I] is a 5-7 membered ring and the heterocyclic aromatic ring in general formula is a 5-7 membered ring containing nitrogen, a sulfur and/or an oxygen, and preferably the alkyl group in general formula [I] has 1-20 carbon atoms.

Each of the above groups or rings may be the substituted, so that, for example, the alkyl group includes substituted or unsubstituted alkyl, the aryl group includes substituted or unsubstituted aryl, and the aromatic ring includes substituted or unsubstituted aromatic ring. The same is true as to the rest of the groups or rings.

The groups and rings appeared in all the general formula [I] include the substituted as explained before.

Although the substituent may be any substituents, preferred ones are one or more appropriately selected from the group consisting of halogen, cyano, hydroxy, amino, nitro, carboxy, an alkyl group, an aryl group, an alkoxy group, an acylamino group, a carbamoyl group, a sulfonamido group, and a sulfamoyl group.

In the present invention, an electrophotosensitive receptor which is excellent in the layer physical property and in such electrophotographic properties as the charge retainability, speed, residual potential, and the like, and is not only less deteriorated by exhaustion when repeatedly used but has no change in the above properties due to heat or light, and thus is capable of displaying stable properties thereof may be produced by the use of an azo compound having the foregoing formula as the photoconductor constituting the electrophotosensitive layer of the electrophotosensitive receptor and by the use of the azo compound, utilizing the excellent carrier generating capability alone of the azo compound of the present invention, as a carrier generating material of the so-called function-separative type electrophotosensitive receptor wherein the carrier-generating and -transport functions are carried out by different materials respectively.

Examples of azo compounds having the foregoing general formula useful for the present invention include, e.g., those having the following formulas, but the azo compounds of the present invention are not limited thereto:

EXEMPLIFIED COMPOUNDS (1)

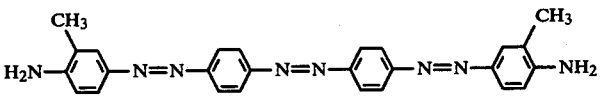

(2)

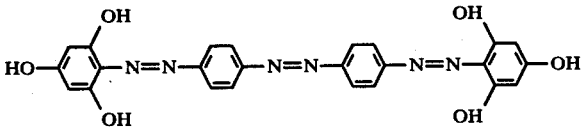

(3)

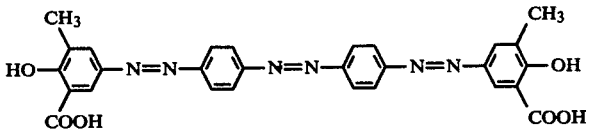

(4)

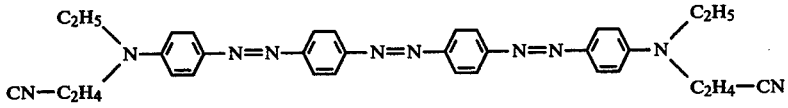

(5)

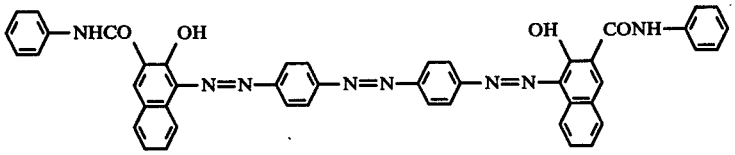

-continued
(6)
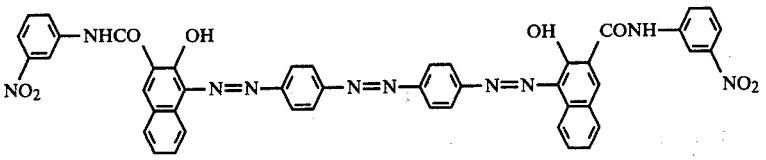
(7)
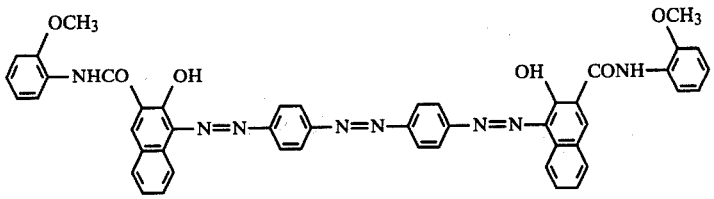
(8)
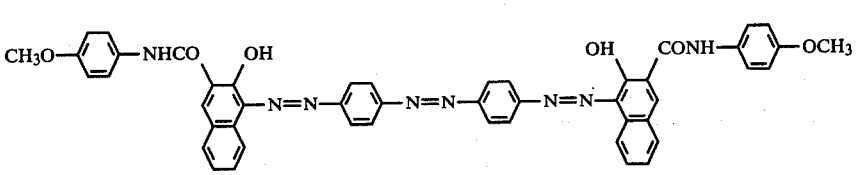
(9)
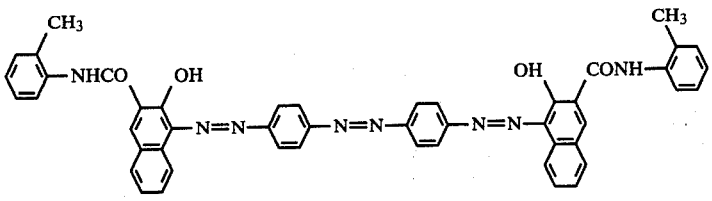
(10)
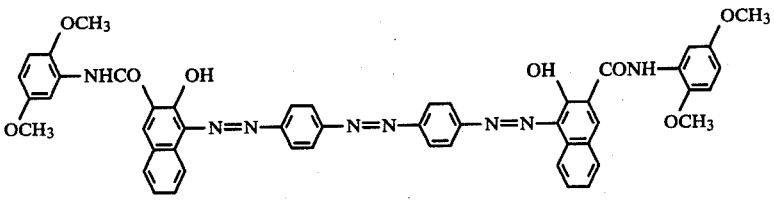
(11)
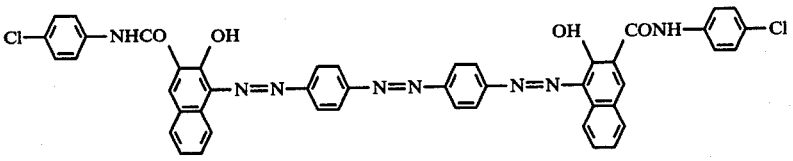
(12)
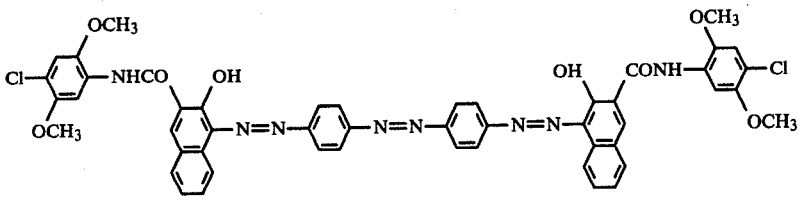
(13)
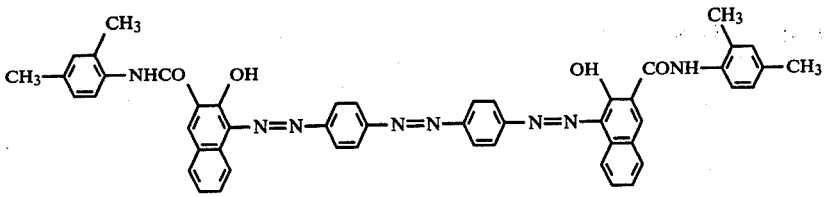
(14)
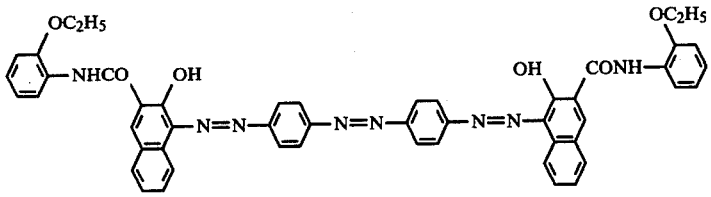

-continued
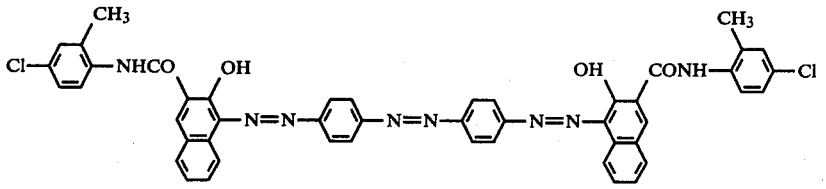
(15)
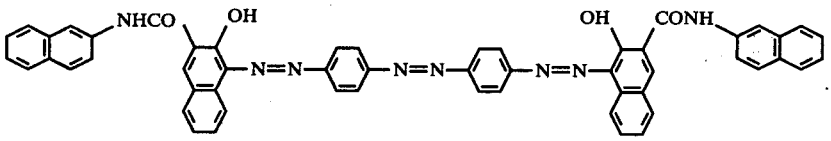
(16)
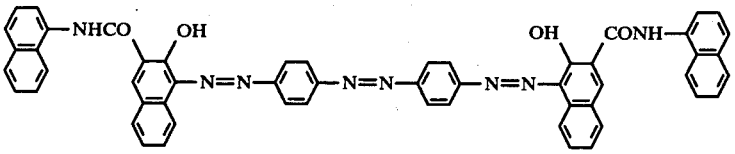
(17)
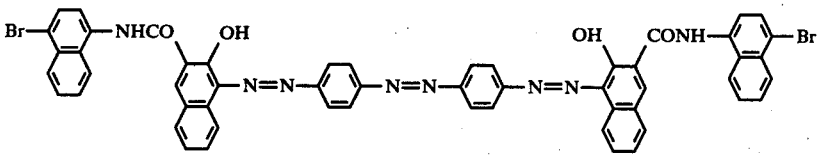
(18)
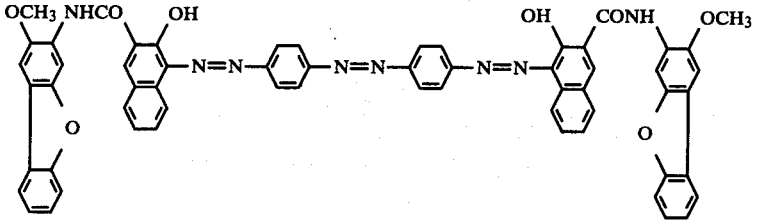
(19)
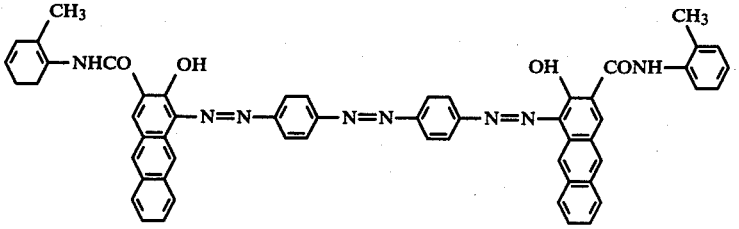
(20)
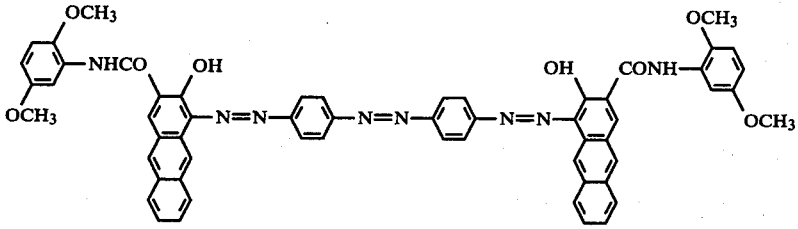
(21)
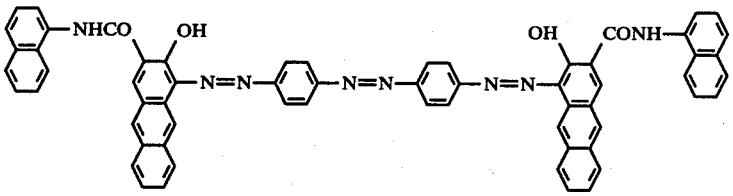
(22)

-continued
(23)
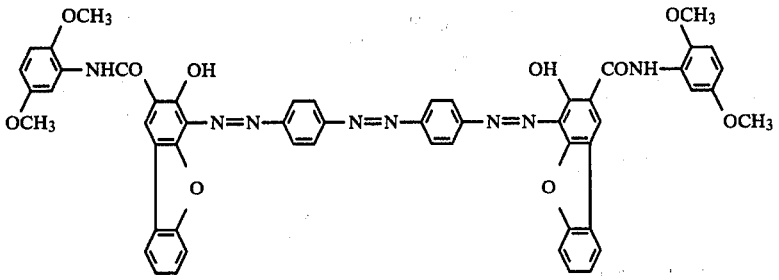
(24)
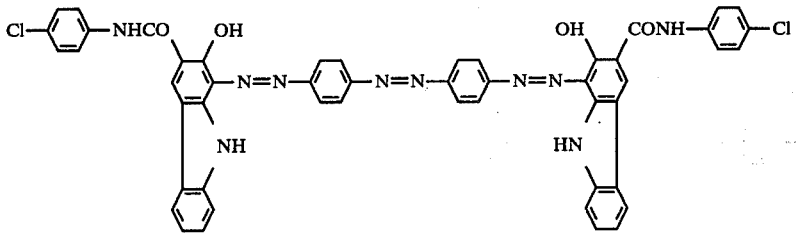
(25)
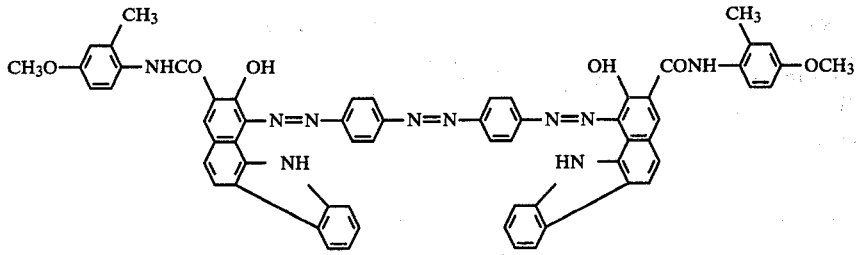
(26)
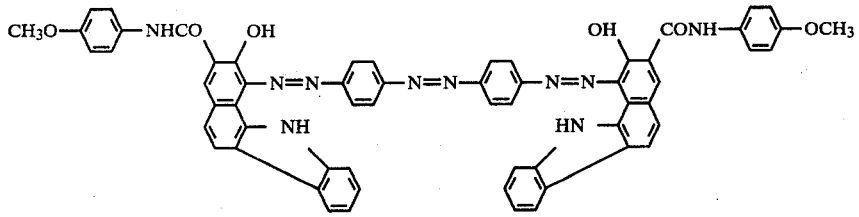
(27)
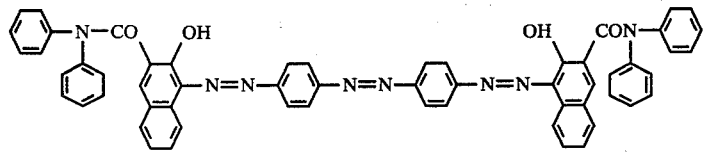
(28)
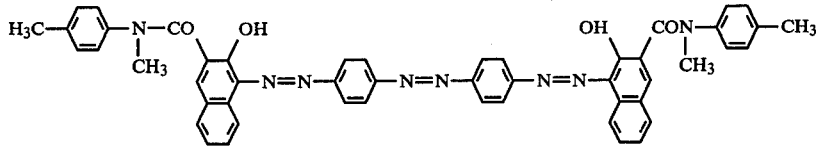
(29)
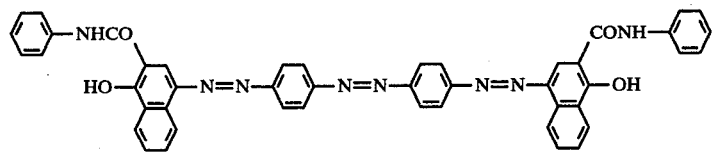

-continued
(30)
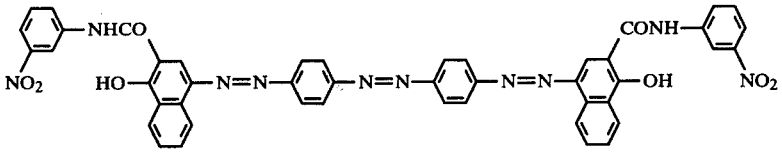
(31)
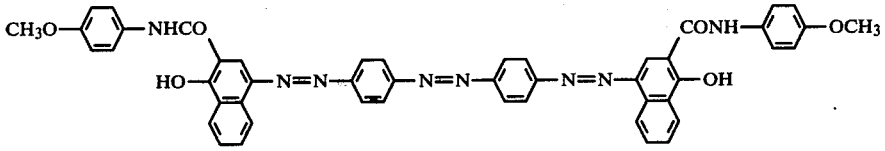
(32)
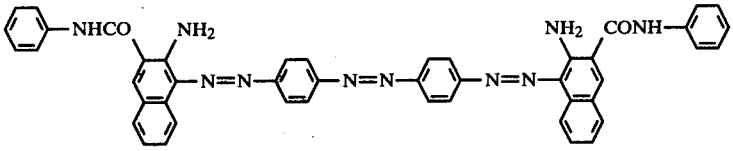
(33)
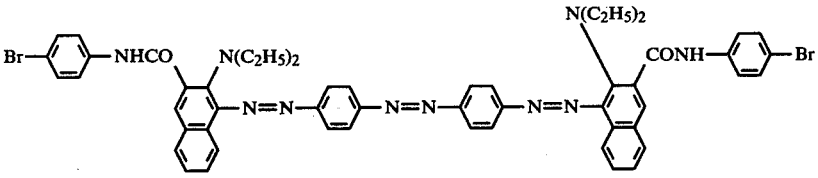
(34)
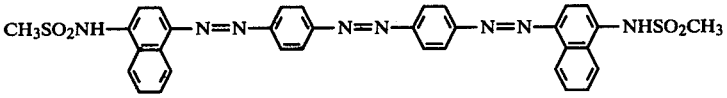
(35)
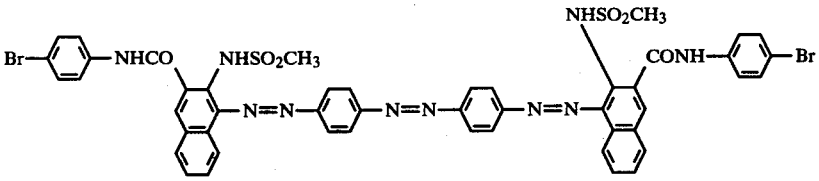
(36)
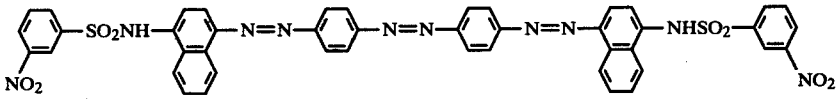
(37)
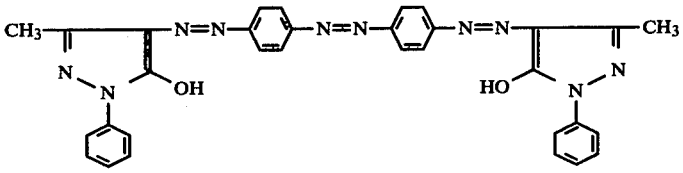
(38)
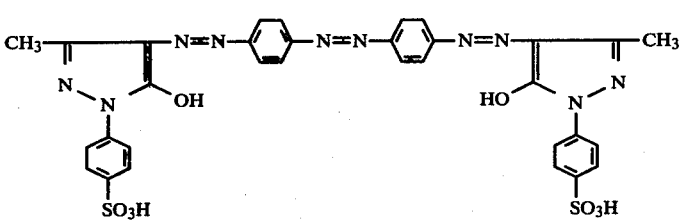

-continued
(39)
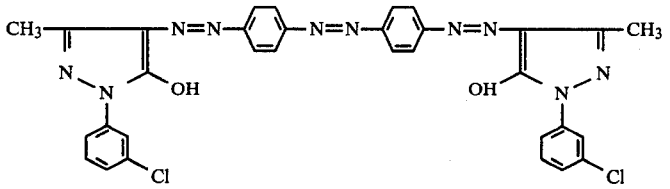
(40)
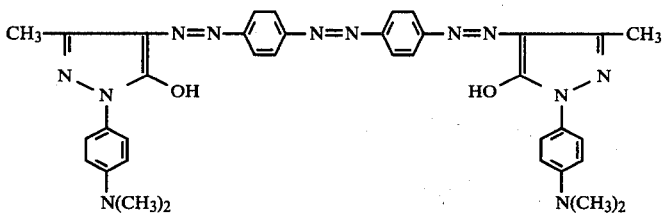
(41)
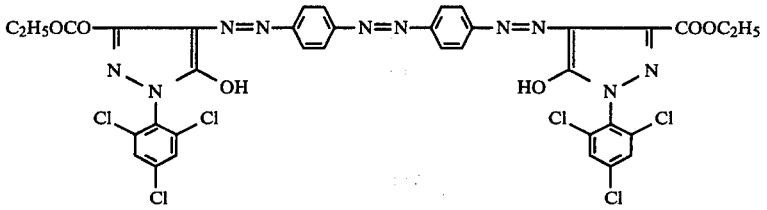
(42)
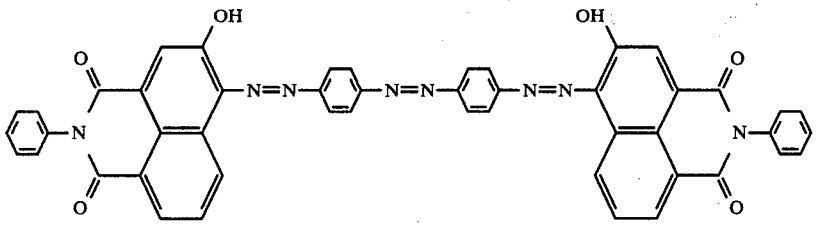
(43)
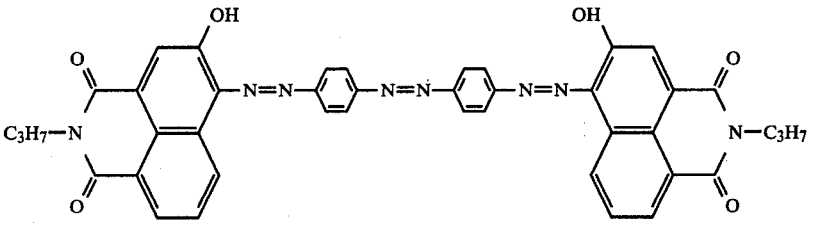
(44)
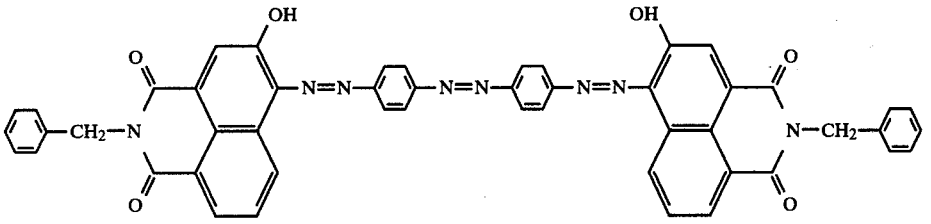
(45)
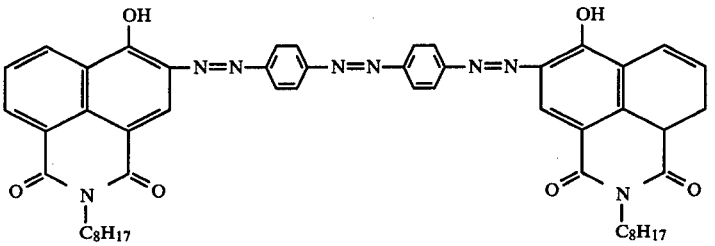

-continued
(46)
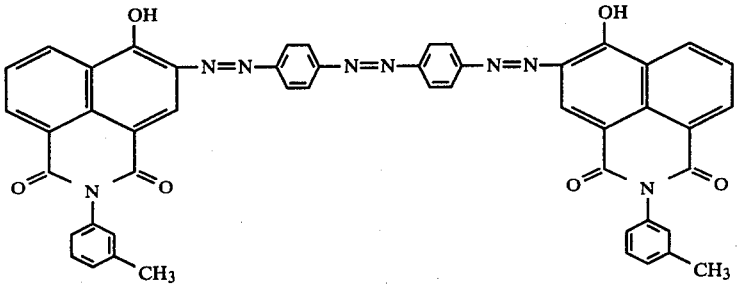
(47)
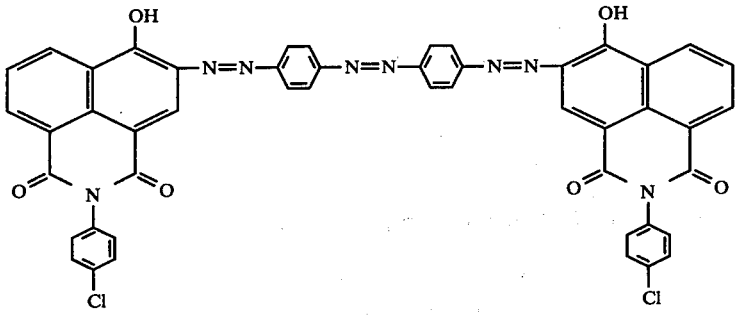
(48)
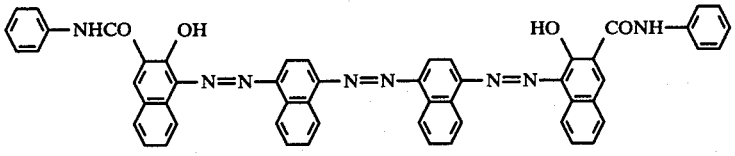
(49)
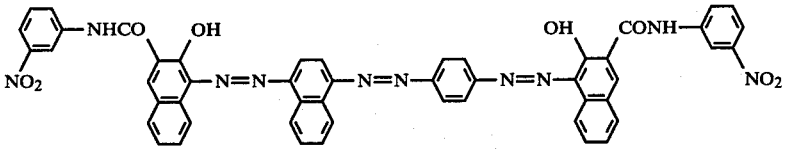
(50)
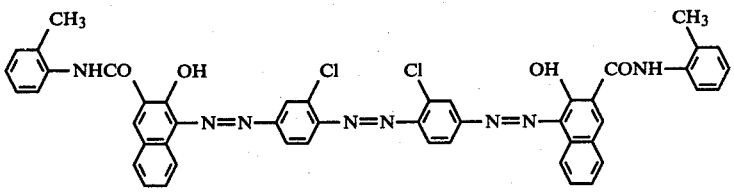
(51)
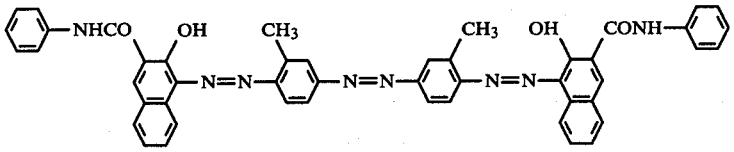
(52)
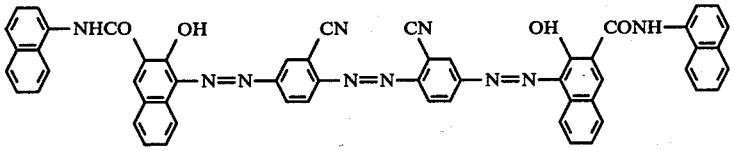
(53)
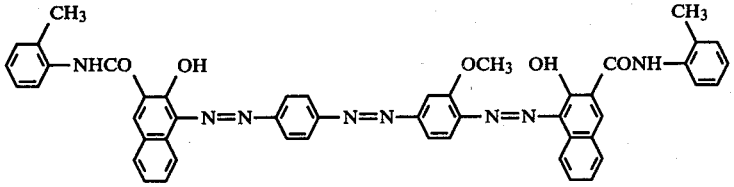

-continued
(54)
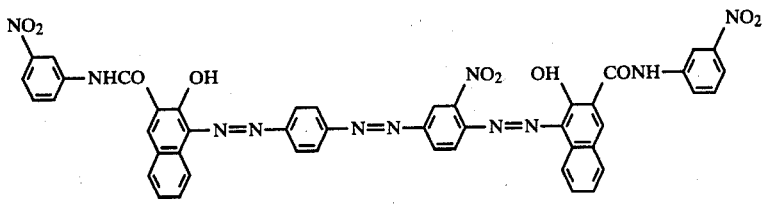
(55)
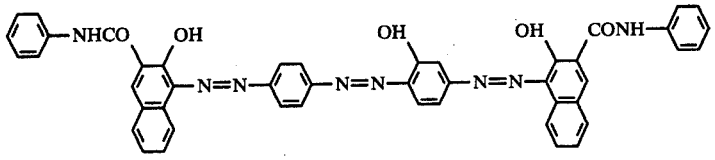
(56)
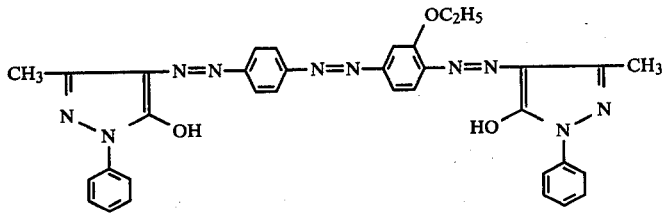
(57)
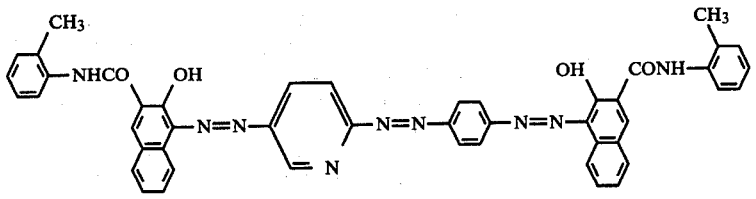
(58)
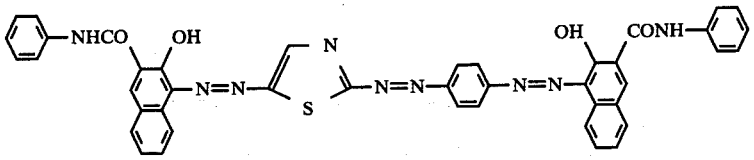
(59)
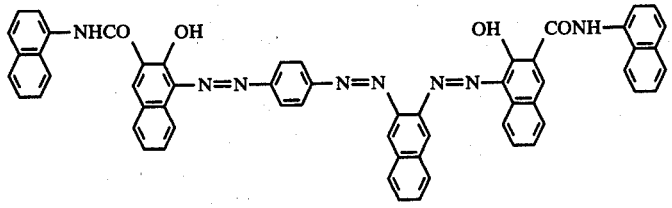
(60)
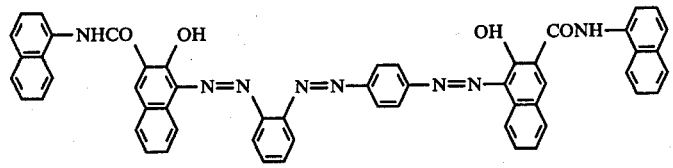
(61)
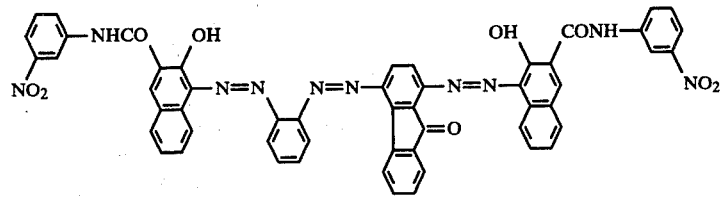

-continued

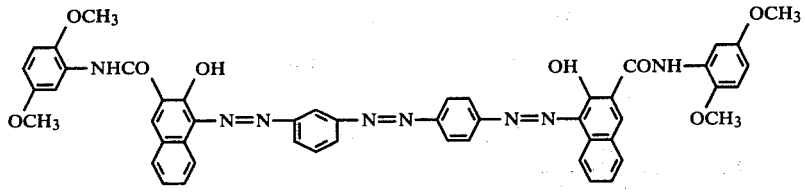

(62)

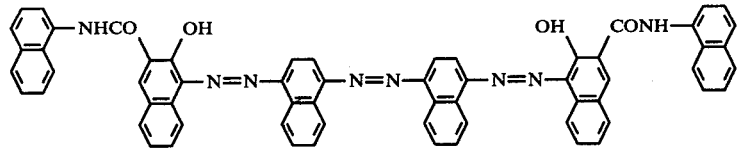

(63)

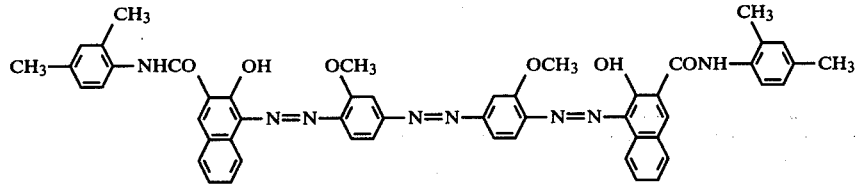

(64)

The above-enumerated azo compounds may be readily synthesized by known methods.

SYNTHESIS EXAMPLE 1

Synthesis of Exemplified Compound (5)

21.2 g (0.1 mol) of 4,4-azo-dianiline are added to and dispersed in a solution of 500 ml of concentrated hydrochloric acid dissolved into 1000 ml of water, and to the dispersed mixture is added dropwise at 5° C. with cooling by ice a solution of 13.8 g (0.2 mol) of sodium nitrite dissolved into 100 ml of water, and after completion of the dropping, the reaction of the mixture take place with stirring for one hour. After completion of the reaction, the reaction liquid is filtered, and to the filtrate are added 300 ml of a 42% hydroborofluoric acid to deposit a precipitate, which is then filtered, washed and then sufficiently dried. The obtained salt is dissolved into 500 ml of N,N-dimethyl formamide to prepare a diazonium salt solution to be used for the subsequent reaction.

Subsequently, 52.7 g (0.2 mol) of 2-hydroxy-3-naphthoic acid anilide (naphthol AS) and 54 g of triethanolamine are dissolved into 2000 ml of N,N-dimethyl formamide to prepare a solution, to which is added dropwise the above-prepared diazonium salt solution with cooling by ice, and the reaction of the mixture is effected with stirring for additional two hours.

After that, the deposited precipitate is filtrated, washed first with N,N-dimethyl formamide and then with acetone, and then dried, whereby 70.0 g (92.0%) of an objective azo compound is obtained. Melting point (M.P.) not less than 300° C. From the test results of the obtained product showing amide absorption of $\nu=1680$ $cm^{-1}$ in the infrared absorption spectrum and molecular ion peak of m/e=760 in the FD mass spectrum, it is understood that the objective azo compound has been surely obtained.

The azo compound of the present invention has an excellent photoconductivity. The production of an electrophotosensitive receptor with the use of the compound may be carried out by providing on a conductive support an electrophotosensitive layer having a binder into which the azo compound of the present invention is dispersed. In addition to this, a multilayered type or dispersion type of the so-called function-separative type electrophotosensitive receptor may also be produced by the use of the compound of the present invention as a carrier generation material utilizing the excellent carrier generation function in the photoconductivity thereof in combination with other efficient carrier transporting material.

In synthesizing an azo compound of the present invention having the foregoing general formula (I), a by-product can sometimes be produced which has a general formula (II):

$$A—N=N—Ar_1—N=N—Ar_2—X \quad (II)$$

wherein A, $Ar_1$ and $Ar_2$ are as defined in the previously mentioned formula (I); and X is a hydrogen or a hydroxy.

Surprisingly, the by-product itself also has a photoconductivity, and the mixing into by this azo compound will not degrade the electrophotographic properties of the azo compound of the present invention having Formula (I).

Figure 2:
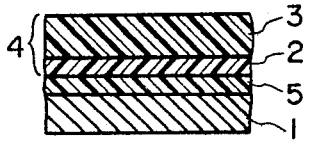
Figure 3:
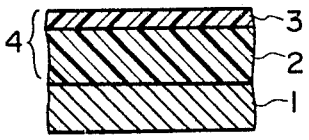
Figure 4:
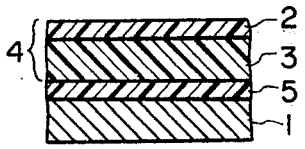
Figure 5:
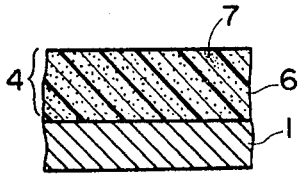
Figure 6:
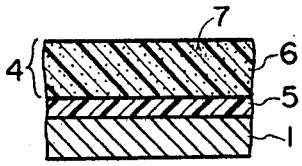

Various mechanical compositions of an electrophotosensitive receptor have been known, and the electrophotosensitive receptor of the present invention may be of any of those conventional compositions and may be normally of the compositions as shown in FIG. 1 to FIG. 6. FIGS. 1–6 are a cross-sectional view showing examples of the mechanical composition of an electrophotosensitive receptor of the present invention. FIG. 1 and FIG. 3 show a conductive support 1 provided thereon with an electrophotosensitive layer 4 comprises a carrier generation layer 2 consisting of the above-mentioned azo compound and carrier transporting layer 3 containing as the principal component thereof a carrier transporting material. The electrophotosensitive layer 4, as shown in FIG. 2 and FIG. 4, may also be provided on a conductive support through an interlayer 5. When photosensitive layer 4 is composed as the above two-layer composition, an electrophotosensitive receptor having the most excellent electrophotographic properties can be obtained. And in the present invention, as shown in FIG. 5 and FIG. 6, electrophotosensitive layer 4 prepared by dispersing the foregoing carrier generation material 7 into a layer 6 containing, as the principal component thereof, a carrier transporting material may be provided directly on or through an interlayer 5 on a conductive support 1.

When the azo compound of the present invention is used as a carrier generation material, a carrier transporting material which may be used in combination therewith include, in addition to such an electron-transportable electron acceptor as trinitrofluorenone, tetrafluorenone, and the like, and a positive hole-transportable electron doner such as polymers having a heterocyclic compound in the side chain thereof as represented by poly-N-vinyl carbazole; and derivatives of triazoles, oxadiazoles, imidazoles, pyrazolines, polyaryl alkanes, phenylenediamines, hydrazones, amino-substituted chalcones, triarylamines, carbazoles, stilbenes; and the like; but those carrier transporting materials applicable to the present invention are not limited to these compounds.

Carrier generation layer 2 of two-layered photosensitive layer 4 may be formed in the following manners directly on a conductive support 1 or on a carrier transporting layer 3, or, if necessary, on an interlayer such as an adhesive layer, a barrier layer, or the like provided thereon:

(1) A solution prepared by dissolving the azo compound into an appropriate solvent or a mixture prepared by at need adding a binder material to the solution is coated.

(2) The azo compound is dispersed by means of a ball mill or a homomixer into a dispersion medium to be made in the finely particulate form, to which is at need added a binder material, to thereby form a dispersed mixture liquid, which is then coated.

Those solvents or dispersion media for use in the formation of the carrier generating material include n-butylamine, diethylamine, ethylenediamine, isopropanolamine, triethanolamine, triethylenediamine, N,N-dimethyl-formamide, acetone, methylethyl ketone, cyclohexanone, benzene, toluene, xylene, chloroform, dichloroethane, dichloromethane, tetrahydrofuran, dioxane, methanol, ethanol, isopropanol, ethyl acetate, butyl acetate, dimethyl sulfoxide, and the like.

For the carrier generation layer or carrier transporting layer any arbitrary binder material may be used, but the material to be used is desired to be an electric insulating film-formable polymer which is hydrophobic and highly dielectric. Such polymer include, e.g., the following compounds, but the binder materials applicable to the present invention are not limited thereto:

(1) Polycarbonates,
(2) Polyesters,
(3) Methacrylic resins,
(4) Acrylic resins,
(5) Polyvinyl chloride,
(6) Polyvinylidene chloride,
(7) Polystyrene,
(8) Polyvinyl acetate,
(9) Styrene-butadiene copolymer,
(10) Vinylidene chloride-acrylonitrile copolymer,
(11) Vinyl chloride-vinyl acetate copolymer
(12) Vinyl chloride-vinyl acetate-maleic anhydride copolymer,
(13) Silicone resin,
(14) Silicone-alkyd resin,
(15) Phenol-formaldehyde resin,
(16) Styrene-alkyd resin, and
(17) Poly-N-vinyl carbazole.

These binder materials may be used in single or in the form of a mixture of not less than two kinds thereof.

The thickness of the thus formed carrier generation layer 2 is desirable to be from 0.01 μm to 20 μm and more preferably from 0.05 μm to 5 μm. If the carrier generation layer or electrophotosensitive layer is of the dispersion system, the particle diameter of the azo compound is desired to be not more than 5 μm, and more preferably not more than 1 μm.

Materials used for the conductive support of the electrophotosensitive receptor of the present invention include metal plates; such conductivity-provided paper plastic film or the like produced by the coating, vacuum deposition or lamination thereon of a conductive compound such as a conductive polymer, indium oxide, or the like or of a metal thin layer such as of aluminum, palladium, gold, or the like.

Materials usable for such an interlayer as the adhesion layer or the barrier layer include, in addition to the foregoing polymer used as the binder material, such organic macromolecular materials as gelatin, casein, starch, polyvinyl alcohol, ethyl cellulose, carboxymethyl cellulose and the like, and aluminum oxide.

The electrophotosensitive receptor of the present invention is of the composition as has been described above, and, as will be apparent from examples given below, is excellent in the charging property, sensitivity and image formability, and particularly excellent in such the durability that it is less deteriorated by exhaustion which repeatedly used.

The present invention is illustrated in reference to exaxmples below, but the embodiments of the present invention are not limited thereto.

EXAMPLE 1

A 2% ethylenediamine solution of Exemplified Compound (5) was coated on an aluminum-laminated polyester film so that the thickness thereof could become 0.5 μm after drying, thereby forming a carrier generation layer. Further on this layer, as a carrier transporting layer, a solution prepared by dissolving 10 g of 1-phenyl-3-(p-diethylaminostyryl)-5-(p-diethylaminophenyl)-pyrazoline and 14 g of polycarbonate resin (Panlite L-1250 manufactured by Teijin Kasei K.K.) into 140 ml of dichloromethane was coated and dried so that the thickness thereof could become 12 μm after drying.

The thus obtained electrophotosensitive receptor was evaluated for the following properties by means of an electrostatic paper tester Model SP-428 (manufactured by Kawaguchi Electric Works). When charging was applied to the photoreceptor for 5 seconds at 6 KV, the surface potential (VA) was −912 V. The surface potential ($V_1$) after being left in the dark for 5 seconds was −817 V. This was then exposed to a halogen lamp light so that the illumination on the surface could become 35 lux, and when an exposure required to reduce by half the surface potential was measured, then it was 2.8 lux.sec. And the surface potential (residual potential) $V_R$ after being exposed to the light with the exposure of 30 lux.sec. was 0 V.

CONTROL EXAMPLE 1

A control electrophotosensitive receptor was prepared in the same manner as in Example 1 with the exception that as a carrier generation material, the following bis-azo compound was used in place of the Exemplified Compound (5), said bis-azo compound having the formula:

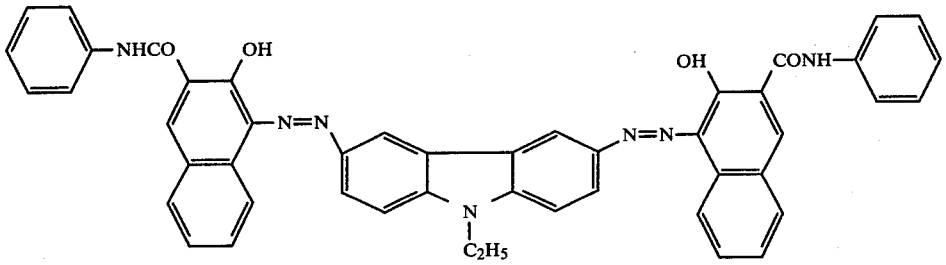

and the control sample was measured for $E_{\frac{1}{2}}$ in the same manner as in Example 1, then it was 12.7 lux.sec., while the $V_R$ was −31 V.

EXAMPLE 2

Another electrophotosensitive receptor was prepared in the same manner as in Example 1 with the exception that Exemplified Compound (13) was used in place of the Exemplified Compound (5), and when the receptor was measured for $E_{\frac{1}{2}}$ and $V_R$, then the results were 3.1 lux.sec. and 0 V, respectively.

CONTROL EXAMPLE 2

Another control electrophotosensitive receptor was prepared in the same manner as in Example 1 with the exception that the following azo compound was used in place of Exemplified Compound (5), said azo compound having the formula:

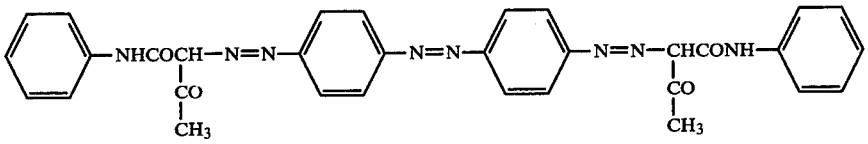

and when the control receptor was measured for $E_{\frac{1}{2}}$ and $V_R$, then the results were 9.5 lux.sec. and −42 V, respectively.

EXAMPLE 3

Two grams of Exemplified Compound (9) and 2 g of polycarbonate resin (Panlite L-1250) were added to 100 ml of dichloromethane, and the mixture was dispersed by means of a ball mill over a period of 12 hours. The liquid was coated as a carrier generation layer on an aluminum-deposited polyester film so that the thickness of the layer could become 2 μm after drying, and on this was further coated and dried a solution prepared by dissolving 6 g of tri-p-tolylamine and 10 g of a polyester resin (Vylon 200, manufactured by Toyobo Co., Ltd.) into 120 ml of dichloroethane so that the coated thickness could become 12 μm after drying. When the resulting electrophotosensitive receptor was measured, similarly to as in Example 1, for $E_{\frac{1}{2}}$, the exposure required for reducing by half the surface potential, then the result was 2.8 lux.sec., while the result for $V_R$, the residual potential, was 0 V.

CONTROL EXAMPLE 3

A further control electrophotosensitive receptor was prepared in the same manner as in Example 3 with the exception that the following azo compound was used in place of the Exemplified Compound (9), said azo compound having the formula:

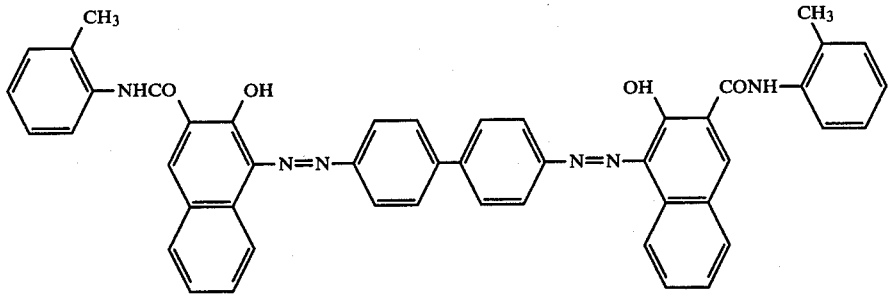

and when the receptor was measured, similarly to as in Example 1, for $E_{\frac{1}{2}}$ and for $V_R$, the results were 6.9 lux.sec. and −29 V, respectively.

EXAMPLE 4

An electrophotosensitive receptor was prepared in the same manner as in Example 1 with the exception that Exemplified Compound (16) was used in place of the Exemplified Compound (5), and this was applied to an electrophotographic copier U-Bix 2000R (manufactured by Konishiroku Photo Industry Co., Ltd.), whereby a contrasty and clear image copy as true as the original was obtained, which these properties were not changed even after repeating the copying 20,000 times.

CONTROL EXAMPLE 4

A control electrophotosensitive receptor was prepared in the same manner as in Example 1 with the exception that the following bis-azo compound was used in place of the Exemplified Compound (5), said bis-azo compound having the formula:

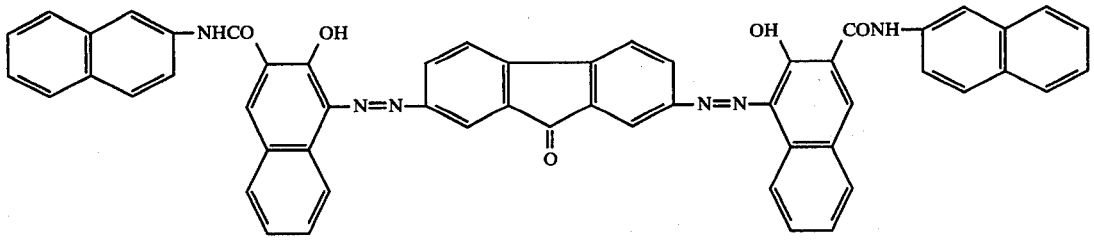

and this was used to make copies in the same manner as in Example 4, then there were obtained nothing but much fogged copies.

EXAMPLE 5

A solution prepared by dissolving 10 g of 1,1-bis(4-N,N-dibenzylaminophenyl)butane and 14 g of a polycarbonate resin (Panlite L-1250) into 150 ml of dichloroethane, was coated as a carrier transporting layer on an aluminum-deposited polyester film so that the coated thickness could become 10 μm after drying, and on this was further coated and dried, as a carrier generation layer, an ethylenediamine solution of Exemplified Compound (17) so that the coated thickness could become 1 μm after drying, whereby an electrophotosensitive receptor was obtained. This receptor was measured for $E_{\frac{1}{2}}$ and $V_R$ in the same manner as in Example 1 with the exception that positive charging (charging voltage +6 KV for 5 seconds) was applied instead of the negative charging that was charged in Example 1, and the results showed 4.8 lux.sec. and +11 V, respectively.

EXAMPLE 6

A dispersion liquid prepared by dispersing by means of a ball mill over a period of 12 hours a mixture of 10 g of a polyester resin (Vylon 200, manufactured by Toyobo Co., Ltd.), 5 g of 2,5-bis(4-diethylaminophenyl)-1,3,4-oxadiazole and 3 g of Exemplified Compound (26) was coated on an aluminum-deposited polyester film so that the coated thickness could become 8 μm after drying, thereby preparing a single-layer electrophotosensitive receptor. The resulting receptor was measured, applying positive charging, in the same manner as in Example 5 for $E_{\frac{1}{2}}$ and $V_R$, and the results showed 5.0 lux.sec. and 0 V, respectively.

EXAMPLE 7

A dispersion liquid prepared by dispersing by means of a ball mill over a period of 24 hours a mixture of 5 g of Exemplified Compound (43), 3.3 g of a polycarbonate resin (Panlite L-1250) and 100 ml of dichloromethane was coated through a 0.05 μm-thick interlayer consisting of a vinyl chloride-vinyl acetate-maleic anhydride copolymer, "S-lec MF-10" (manufactured by Sekisui Chemical Co., Ltd.), on an aluminum-deposited polyester film so that the coated thickness could become 10 μm after drying to thereby prepare an electrophotosensitive receptor. The thus obtained receptor was measured, applying positive charging, for the exposure required for reducing by half the surface potential and for the residual potential in the same manner as in Example 5, and the results were 6.2 lux.sec. and +10 V, respectively.

EXAMPLE 8

A 2% ethylenediamine solution of Exemplified Compound (6) was coated, through a 0.05 μm-thick interlayer consisting of a vinyl chloride-vinyl acetate-maleic anhydride copolymer (S-lec MF-10), on an aluminum-deposited polyester film so that the coated thickness could become 0.5 μm after drying, thereby forming a carrier generation layer. And on this was further coated, as a carrier transporting layer, a solution prepared by dissolving 10 g of 1,1-bis(4-N,N-diethylamino-2-methylphenyl)-1-phenyl methane and 14 g of a polycarbonate resin (Panlite L-1250) into 140 ml of dichloromethane so that the coated thickness could become 12 μm after drying.

The thus obtained electrophotosensitive receptor was measured for $E_{\frac{1}{2}}$ and for $R_R$ in the same manner as in Example 1, and further applied to an electrophotographic copier U-Bix 2000R to repeat charging-exposure operations 5000 times for a durability test, and then was again measured in the same manner. The tested results are as shown in Table 1.

TABLE 1

| | 1st | Durability test after 5000-time charging-exposure operations |
|---|---|---|
| $E_{\frac{1}{2}}$ (lux · sec.) | 2.8 | 3.1 |
| $V_R$ (V) | 0 | −16 |

As apparent from the results, the change in the respective properties is extremely small even after the durability test of repeating charging-exposure operations 5000 times.

CONTROL EXAMPLE 5

A control electrophotosensitive receptor was prepared in the same manner as in Example 8 with the exception that the following azo compound was used in place of the Exemplified Compound (6), said azo compound having the formula:

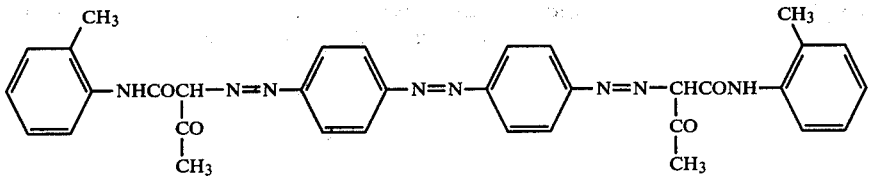

and the prepared electrophotosensitive receptor was measured in the same manner as in Example 8. The results are as shown in Table 2.

TABLE 2

| | 1st | Durability test after 5000-time charging-exposure operations |
|---|---|---|
| $E_{\frac{1}{2}}$ (lux · sec.) | 8.5 | 11.0 |
| $V_R$ (V) | −31 | −129 |

As apparent from the results, after the durability test of repeating 5000-time charging-exposure operations, not only does the sensitivity become deteriorated but the residual potential increases, so that the photoreceptor becomes degraded in the properties thereof.

As has been mentioned, the electrophotosensitive receptors containing the azo compound of the present invention is so excellent that it has higher sensitivity and less residual potential than those of the control electrophotosensitive receptors.

What is claimed is:

1. An electrophotosensitive receptor comprising a conductive support and an electrophotosensitive layer thereon comprising a carrier transporting material and an azo compound selected from the formula $$A—N=N—Ar_1—N=N—Ar_2—N=N—A$$

wherein $Ar_1$ and $Ar_2$ are individually selected from a divalent aromatic ring; and wherein A is selected from

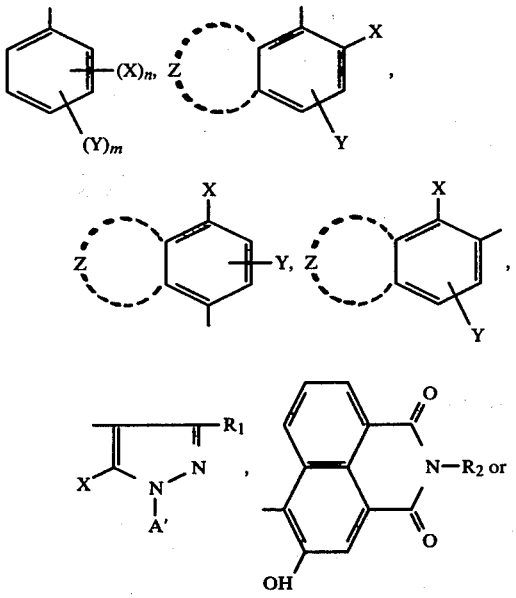

-continued

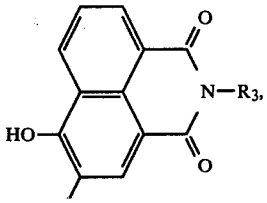

wherein X is selected from a hydroxy group,

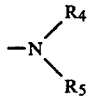

or —$NHSO_2$—$R_6$ wherein $R_4$ and $R_5$ are individually selected from a hydrogen atom or an alkyl group, $R_6$ is selected from an alkyl group and an aryl group; Y is selected from a hydrogen atom, a halogen atom, an alkyl group, an alkoxy group, a carboxy group, a sulfo group, a carbamoyl group and a sulfamoyl group; Z is selected from at least one atomic group necessary for forming an aromatic ring; A' is selected from an aryl group; $R_1$ is selected from a hydrogen atom, an amino group, an alkyl group, a carbamoyl group, or a carboxy group and ester thereof; $R_2$ and $R_3$ are individually selected from an alkyl group, an aralkyl group and an aryl group; m is 0, 1 or 2; and n is 1 or 2, wherein each of the following groups:

$R_4$ and $R_5$-an alkyl group;

$R_6$-an alkyl group and an aryl group;

Y-an alkyl group, an alkoxy group, a carboxy group, a sulfo group, a carbamoyl group, and a sulfamoyl group;

Z-an aromatic ring;

A'-an aryl group;

$R_1$-an amino group, an alkyl group, a carbamoyl group, and a carboxy group;

$R_2$ and $R_3$-an alkyl group, an aralkyl group, and an aryl group;

may be substituted with at least one substituent selected from the group consisting of a halogen atom, a cyano group, a hydroxy group, an amino group, a nitro group, a carboxy group, an alkyl group, an aryl group, an alkoxy group, a acylamino group, a carbamoyl group, a sulfonamido group, and a sulfamoyl group, said azo compound being applied as a coating solution containing a solvent or as a liquid dispersion mixture containing a dispersion medium.

2. The electrophotosensitive receptor according to claim 1, wherein said electrophotosensitive layer comprises a carrier generation layer and a carrier transporting layer, and said carrier generation layer containing said azo compound, and said carrier transporting layer containing said carrier transporting material.

3. The electrophotosensitive receptor according to claim 1, wherein said receptor further comprises an intermediate layer.
4. The electrophotosensitive receptor according to claim 1, wherein said azo compound is selected from the group consisting of
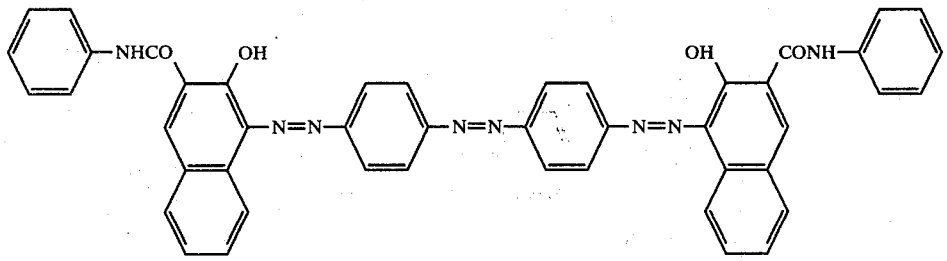
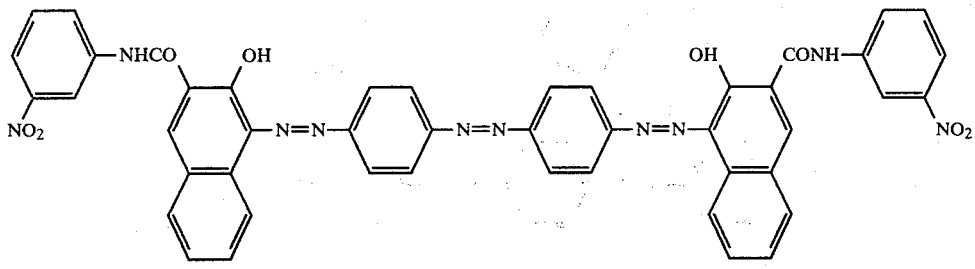
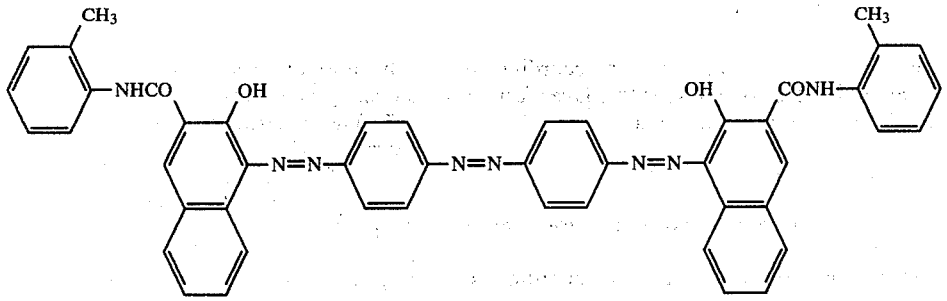
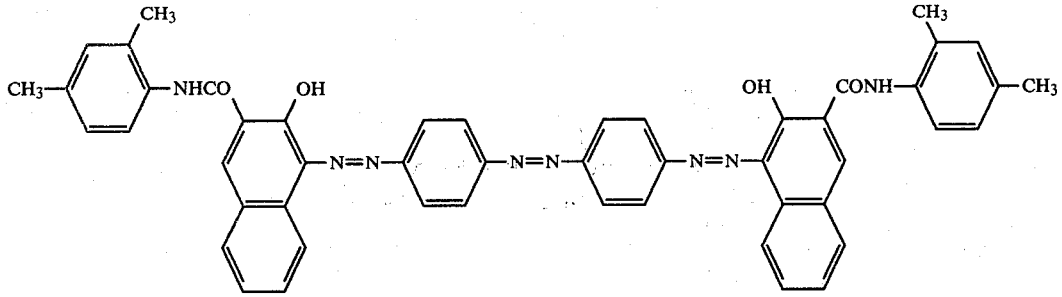
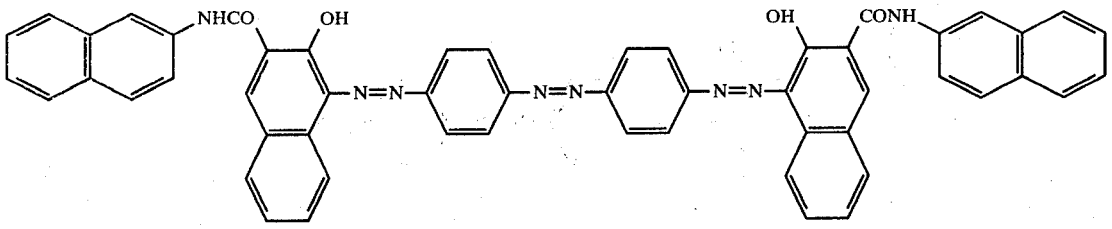

-continued

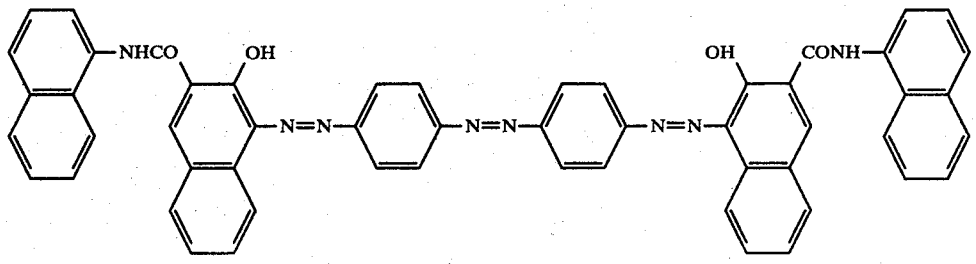

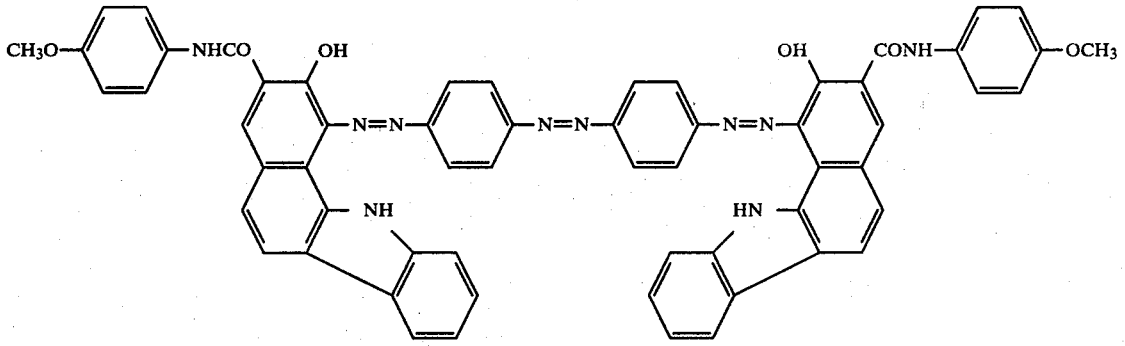

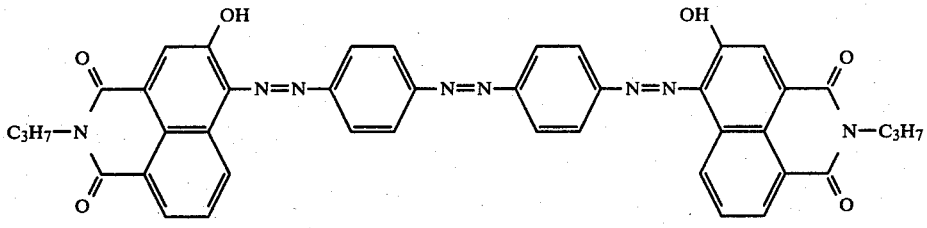

5. The electrophotosensitive receptor according to claim 1, wherein the electrophotosensitive layer further comprises a compound of the formula $$A—N{=}N—Ar_1—N{=}N—Ar_2—Q$$

wherein Q is selected from a hydrogen atom and a hydroxy group.

6. The electrophotosensitive receptor according to claim 2, wherein said azo compound is dissolved in a solvent to form a solution, said solution being applied as a coating at a thickness of between 0.01 to 20 μm.

7. The electrophotosensitive receptor according to claim 1, wherein said electrophotosensitive layer is formed from said azo compound which is dispersed in said dispersion medium, said azo compound being in the form of fine particles having a particle size of up to 5 μm.

8. The electrophotosensitive receptor according to claim 6, wherein said azo compound is selected from

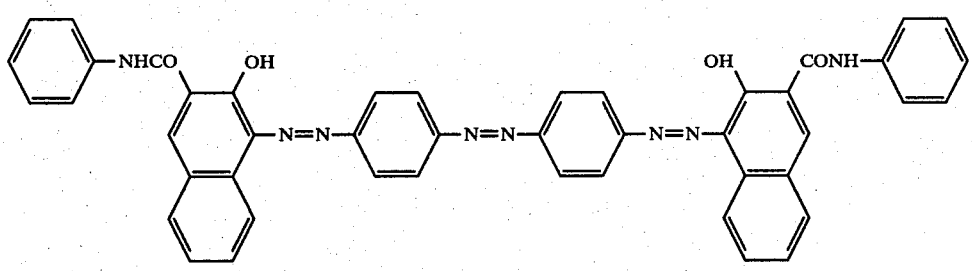

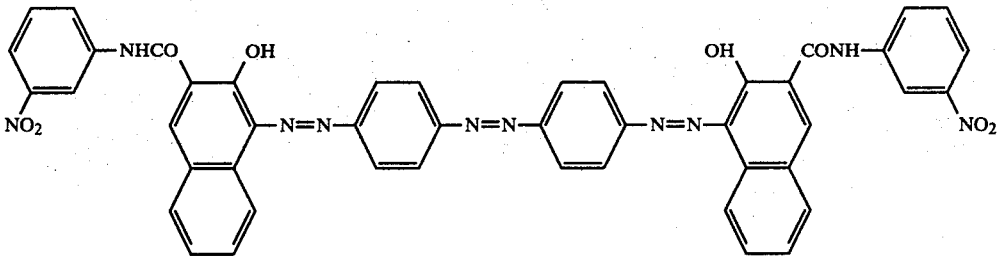

-continued
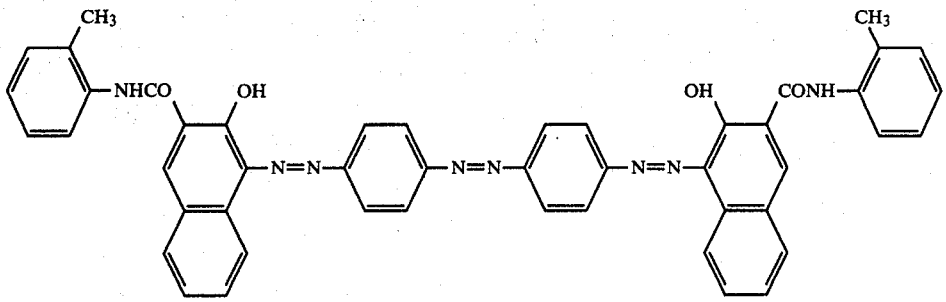
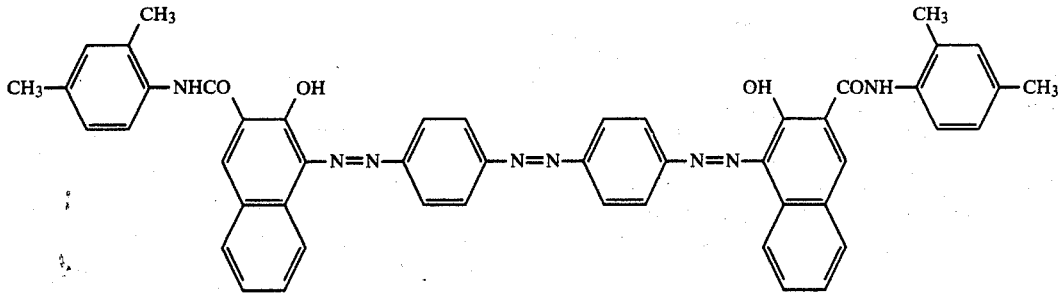
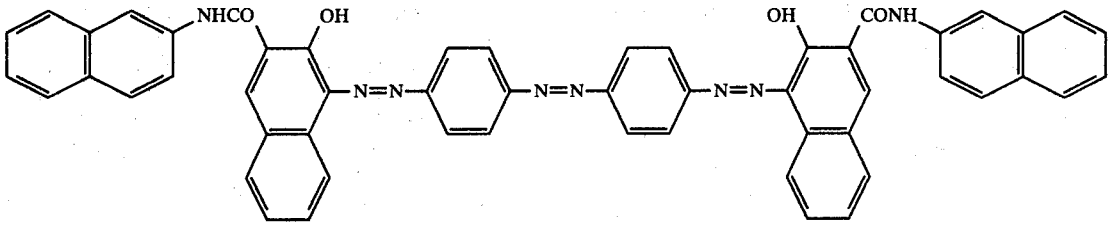
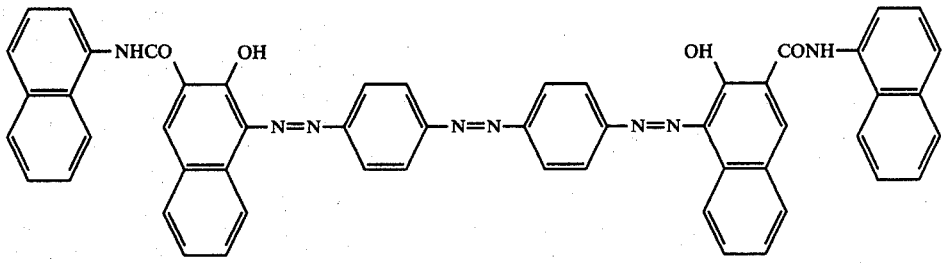
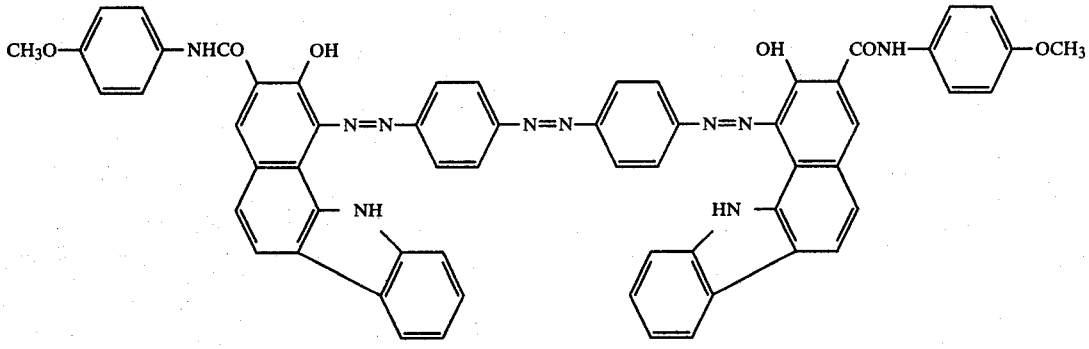

-continued

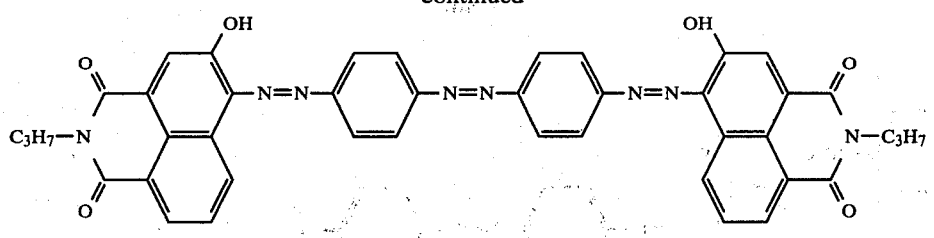

9. An electrophotosensitive receptor according to claim 1, wherein said coating solution or said liquid dispersion mixture further contains a binder.

10. The electrophotosensitive receptor according to claim 1, wherein said liquid dispersion mixture further contains said carrier transporting material.

11. An electrophotosensitive receptor comprising a conductive support and an electrophotosensitive layer thereon comprising an azo compound selected from the formula $$A—N=N—Ar_1—N=N—Ar_2—N=N—A$$

wherein $Ar_1$ and $Ar_2$ are individually selected from a divalent aromatic ring; and wherein A is selected from

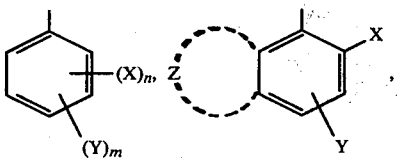

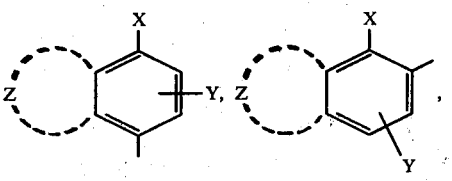

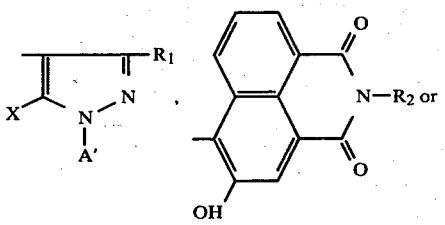

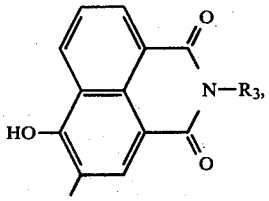

wherein X is selected from a hydroxy group,

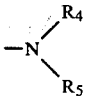

or —$NHSO_2$—$R_6$ wherein $R_4$ and $R_5$ are individually selected from a hydrogen atom or an alkyl group, $R_6$ is selected from an alkyl group and an aryl group; Y is selected from a hydrogen atom, a halogen atom, an alkyl group, an alkoxy group, a carboxy group, a sulfo group, a carbamoyl group and a sulfamoyl group; Z is selected from at least one atomic group necessary for forming an aromatic ring; A' is selected from an aryl group; $R_1$ is selected from a hydrogen atom, an amino group, an alkyl group, a carbamoyl group, or a carboxy group and ester thereof; $R_2$ and $R_3$ are individually selected from an alkyl group, an aralkyl group and an aryl group; m is 0, 1 or 2; and n is 1 or 2, wherein each of the following groups:

$R_4$ and $R_5$-an alkyl group;

$R_6$-an akyl group and an aryl group;

Y-an alkyl group, an alkoxy group, a carboxy group, a sulfo group, a carbamoyl group, and a sulfamoyl group;

Z-an aromatic ring;

A'-an aryl group;

$R_1$-an amino group, an alkyl group, a carbamoyl group, and a carboxy group;

$R_2$ and $R_3$-an alkyl group, an aralkyl group, and an aryl group;

may be substituted with at least one substituent selected from the group consisting of a halogen atom, a cyano group, a hydroxy group, an amino group, a nitro group, a carboxy group, an alkyl group, an aryl group, an alkoxy group, a acylamino group, a carbamoyl group, a sulfonamido group, and a sulfamoyl group, said azo compound being applied as a coating solution containing a binder and a solvent or as a liquid dispersion mixture containing a binder and a dispersion medium.

12. The electrophotosensitive receptor according to claim 10, wherein said azo compound is selected from the group consisting of

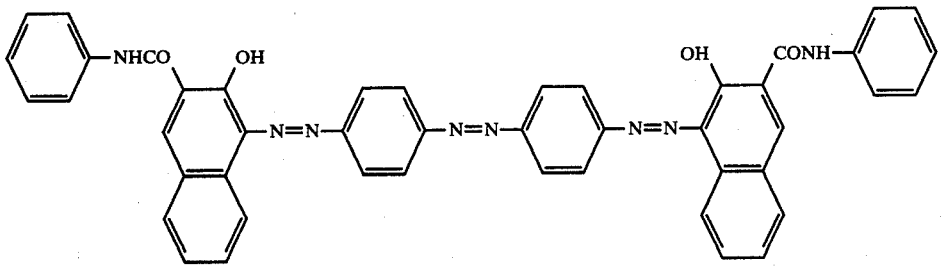
NHCO
OH
N=N
N=N
N=N
OH
CONH
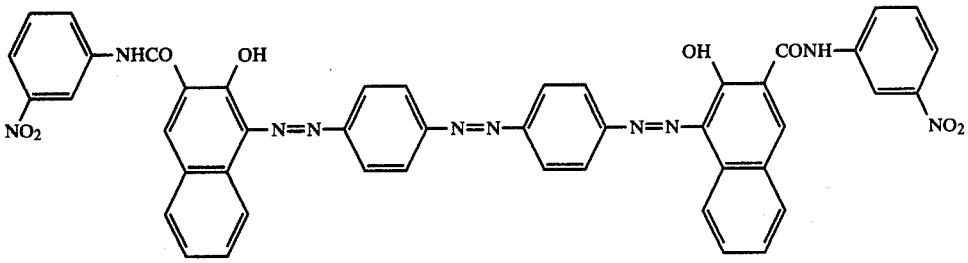
NHCO
OH
NO2
N=N
N=N
N=N
OH
CONH
NO2
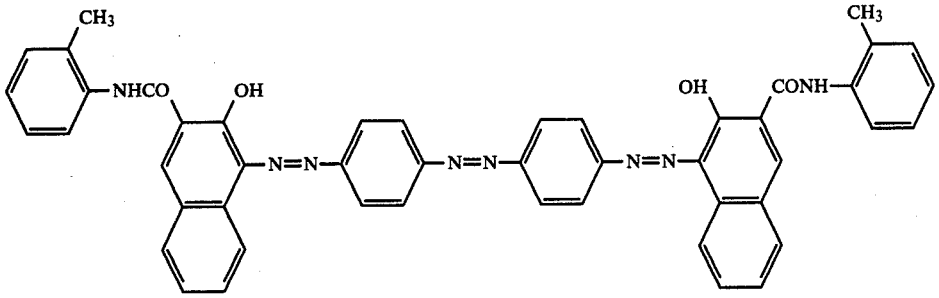
CH3
NHCO
OH
N=N
N=N
N=N
OH
CONH
CH3
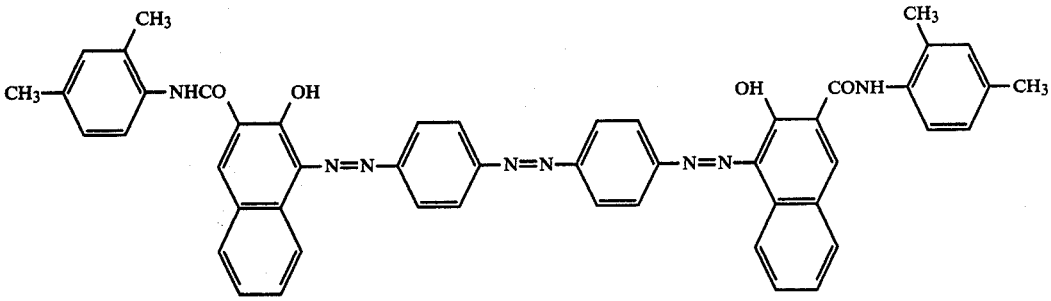
CH3
CH3
NHCO
OH
N=N
N=N
N=N
OH
CONH
CH3
CH3
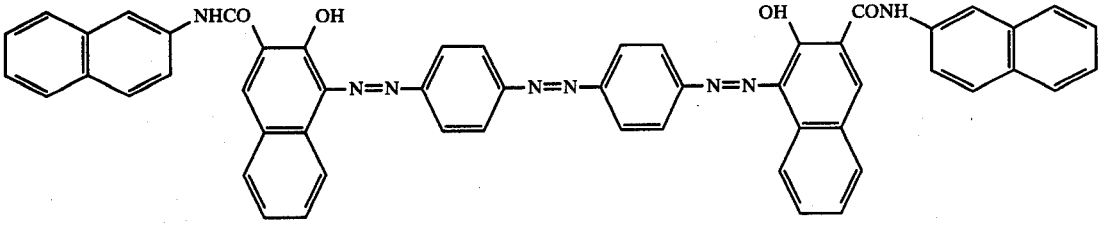
NHCO
OH
N=N
N=N
N=N
OH
CONH
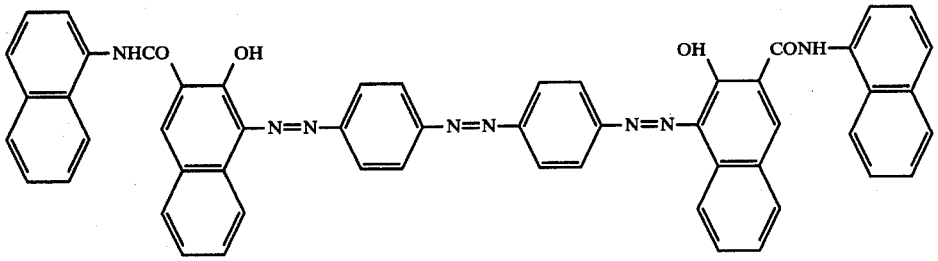
NHCO
OH
N=N
N=N
N=N
OH
CONH -continued

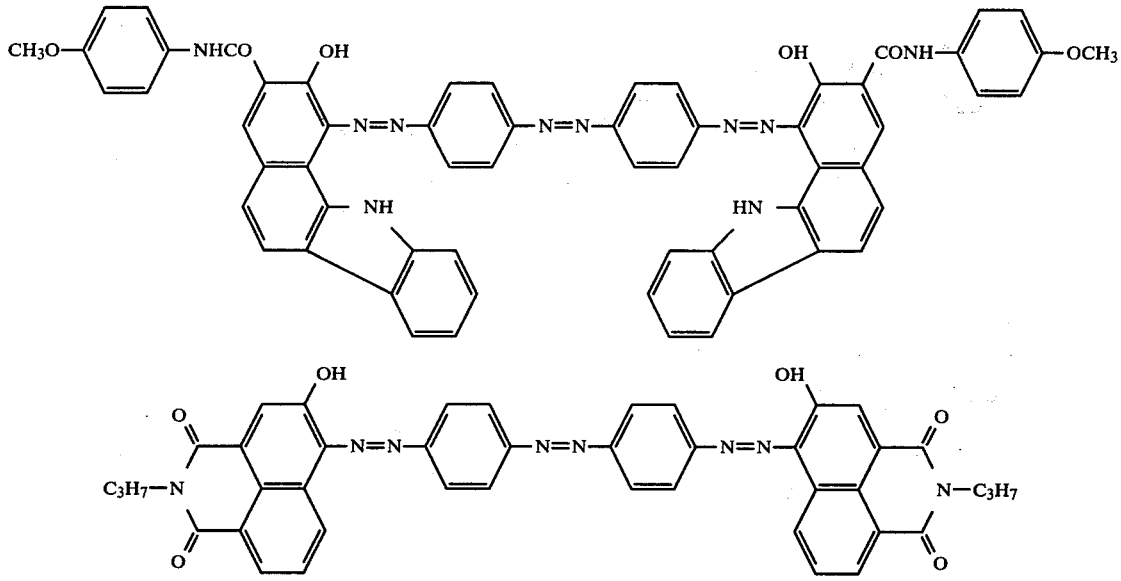

13. The electrophotosensitive receptor according to claim 10, wherein the electrophotosensitive layer further comprises a compound of the formula $$A—N{=}N—Ar_1—N{=}N—Ar_2—Q$$

wherein Q is selected from a hydrogen atom and a hydroxy group.

14. The electrophotosensitive receptor according to claim 10, wherein said coating solution is applied as a coating at a thickness of between 0.01 to 20 μm.

15. The electrophotosensitive receptor according to claim 10, wherein said electrophotosensitive layer is formed from said azo compound which is dispersed in a medium containing said binder, said azo compound being in the form of fine particles having a particle size of up to 5 μm.

* * * * *